US005499465A

United States Patent [19]

Manico

[11] Patent Number: 5,499,465

[45] Date of Patent: Mar. 19, 1996

[54] PRESSURE-SENSITIVE SWITCH FOR TALKING PICTURE FRAME

[75] Inventor: Joseph A. Manico, Rochester, N.Y.

[73] Assignee: Eastman Kodak Company, Rochester, N.Y.

[21] Appl. No.: 402,743

[22] Filed: Mar. 13, 1995

[51] Int. Cl.[6] ..... A47G 7/00

[52] U.S. Cl. ..... 40/152; 40/455; 40/457

[58] Field of Search ..... 40/152, 152.1, 40/457, 455, 464; 200/85 R, 52 A, 52 R, 61.58 A, 61.7; 446/485, 497

[56] References Cited

U.S. PATENT DOCUMENTS

| | | | |
|---|---|---|---|
| 3,370,366 | 2/1968 | Van Zanten | 40/28.1 |
| 3,450,408 | 6/1969 | Hagerman | 446/485 X |
| 3,655,325 | 4/1972 | Toppel | 274/14 |
| 3,857,191 | 12/1974 | Sadorus | 40/28.1 |
| 3,990,166 | 11/1976 | Nagelkirk | 200/61.58 R X |
| 4,299,041 | 11/1981 | Wilson | 40/124.1 |
| 4,541,188 | 9/1985 | Sadorus | 40/152.1 |
| 4,748,756 | 6/1988 | Ross | 40/152.2 |
| 4,791,741 | 12/1988 | Kondo | 40/124.1 |
| 5,063,698 | 11/1991 | Johnson et al. | 40/124.1 |
| 5,182,872 | 2/1993 | Lee et al. | 40/152 |
| 5,213,234 | 5/1993 | Stefanopoulos | 222/78 |
| 5,359,374 | 10/1994 | Schwartz | 354/76 |

*Primary Examiner*—Kenneth J. Dorner
*Assistant Examiner*—Cassandra Davis
*Attorney, Agent, or Firm*—Peter J. Bilinski

[57] ABSTRACT

A talking picture frame includes a pressure-sensitive switch which, when activated, e.g., by lifting the frame from a frame-supporting surface, electrically energizes an audio system housed within the frame to playback a prerecorded personal message which augments the visual information represented by a framed picture. Preferably, the switch includes a plunger-type switch actuator which normally extends downwardly from the bottom edge of the frame. When the bottom edge of the frame is resting on a supporting surface, e.g. a table top, the weight of the frame, in cooperation with the supporting surface, moves the actuator, against a spring force, to a retracted position in which no electrical power is provided to the audio system. When the frame is lifted, the switch actuator moves through a position in which a control signal is produced which initiates playback of the recorded message. Preferably, the switch actuator is movably mounted on the frame so as to extend outwardly from either of two different edges of the frame, whereby the actuator can be engaged and moved to its retracted position by the frame-supporting surface whether the frame is supported in a landscape or portrait orientation.

8 Claims, 5 Drawing Sheets

PRESSURE-SENSITIVE SWITCH FOR TALKING PICTURE FRAME

BACKGROUND OF THE INVENTION

1. Field of the Invention

This invention relates to improvements in picture framing apparatus for displaying pictorial information, such as photographs, prints, paintings and the like. More particularly, it relates to improvements in picture frames of the type which, on command, play an audio message associated with the picture they display.

2. Discussion of the Prior Art

For many years, people have toyed with the idea of incorporating audio systems in picture frames and the like for the purpose of providing the picture viewer with more than just visual gratification in seeing the picture. For example, U.S. Pat. No. 3,857,191 discloses a picture frame in which a tape recorder has been mounted in the frame housing for reproducing, for example, "utterings" made by a person whose picture appears in the frame. Similar devices are disclosed in U.S. Pat. Nos. 4,541,188 and 5,359,374.

In "talking" picture frames of the type disclosed in the above patents, the audio system housed by the frame is commonly activated by a manual movement of an ON/OFF switch mounted on either the front or back side of the frame. In some cases, the location of the ON/OFF switch is not easily ascertained by the casual user or observer and, even when the switch location is learned, its location relative to the normal orientation of the frame (e.g. in the frame's lower right hand corner) will change as the owner changes the orientation of the frame, for example, from a "portrait" orientation, to a "landscape" orientation.

As an alternative to the manually movable ON/OFF switches used in the "talking" picture frames disclosed in the above patents, it is also known to use pressure- or touch-sensitive switches which are embodied in the frame structure. See, for example, the talking picture frames disclosed in U.S. Pat. Nos. 4,748,756 and 5,182,872. While such switches avoid the "cluttered" appearance associated with manually operated push-buttons or knobs, they have a tendency to not always operate as intended. Moreover, the casual observer who is unfamiliar with the frame may not benefit from its audio feature unless instructed, for example, by a visual message on the frame, as to how it is operated (e.g., "Press Here for an Audio Message"). This is especially true where the incorporated audio system has been miniaturized to the point that it is barely, if at all, detectable by visual inspection. With the advent of microelectronics and integrated circuits, it is now possible to miniaturize a sound recording and playback system to the point that it is barely noticeable, even when packaged in a conventional appearing greeting card or the like. Such sound-producing greeting cards are disclosed, for example, in U.S. Pat. Nos. 4,299,041; 4,791,741; and 5,063,698. In such cards, the sound system comprises an electronic memory for storing an audio message (e.g., a voice or musical message) in digital form, a sound synthesizer, and a control circuit for applying the stored audio message to the synthesizer in response to the activation of a switch. Such a switch may take the form of a low profile push-button switch mounted beneath the front surface of the card, or may comprise an electronic switch having an actuator which is moved to a switch-closing position as the greeting card is opened up.

SUMMARY OF THE INVENTION

An object of the present invention is to provide a "talking" picture frame in which the audio system may be automatically activated by merely lifting the frame from a frame-supporting surface.

Another object of this invention is to provide a talking picture frame in which automatic activation of the audio system is not dependent on the orientation of the frame on a frame-supporting surface.

These and other objects of the invention are achieved by the provision of a picture display apparatus comprising: (a) a frame for accommodating a picture provided by a user, such frame having a first side adapted to rest upon a frame-supporting surface to support the frame in a first orientation, and a second side adapted to rest upon such frame-supporting surface to support the frame in a second orientation different from the first orientation; (b) an audio system operatively coupled to the frame for selectively playing prerecorded audio information in response to receiving an electric control signal; and (c) an electric switch for selectively producing the electric control signal. Preferably, the switch comprises (i) a switch actuator which slidably mounted on the frame for movement between extended and retracted positions, such actuator being adapted to produce the control signal during movement between its extended and retracted positions; (ii) biasing means for normally biasing the switch actuator towards its extended position; and (iii) mounting means for movably mounting the switch actuator on the frame for movement between a first position in which the switch actuator, when located in its extended position, extends outwardly from the first side of the frame, and a second position in which the switch actuator, when located in its extended position, extends outwardly from the second side of the frame. Preferably, the switch actuator is positioned on the frame to be contacted by a frame-supporting surface when the switch is located in either its first or second positions and when either the first or second side of the frame, respectively, is resting upon such frame-supporting surface, and the switch actuator is adapted to be moved from its extended position to its retracted position by a force exerted by the weight of the frame interacting with the frame-supporting surface. Most preferred is that the first and second frame sides of the frame are perpendicular to each other, and that the switch actuator is rotatably mounted in a corner of the frame for movement of at least 90 degrees.

An advantageous technical effect of the invention is that a single, lift-operated switch can, by virtue of its ability to have the location of its actuator changed, initiate playback of a recorded message regardless of the orientation (e.g. portrait or landscape) in which the frame is used. Other advantages are discussed below.

The invention and its various advantages will be better understood from the ensuing detailed description of preferred embodiments, reference being made to the accompanying drawings.

DETAILED DESCRIPTION OF PREFERRED EMBODIMENTS

Figure 2:
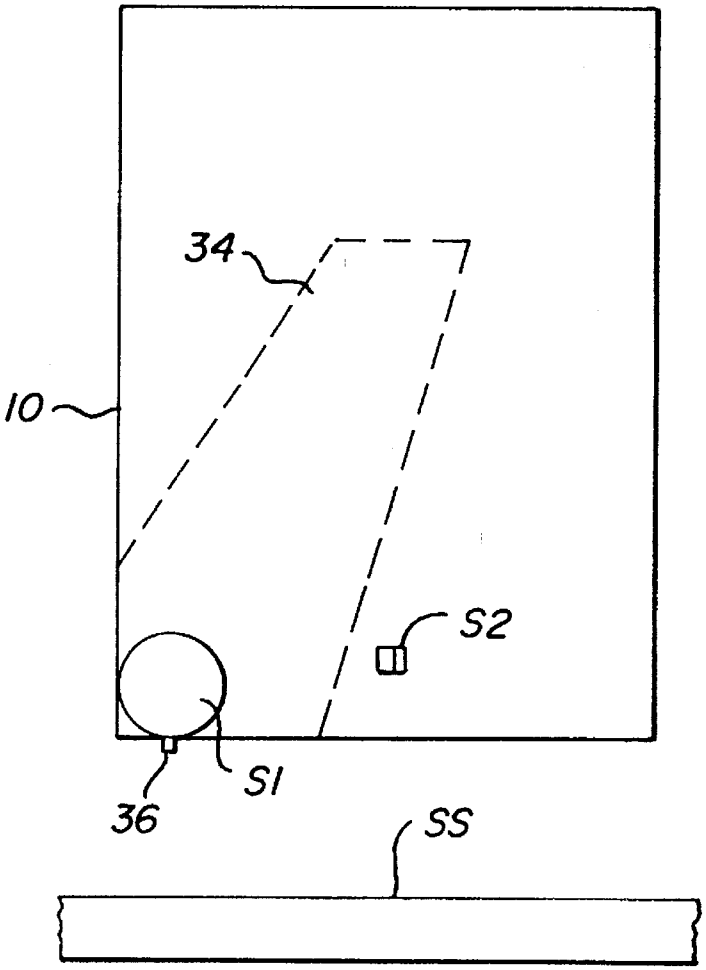
FIG. 2 is a rear plan illustration of the frame illustrated in FIG. 1.
Figure 8:
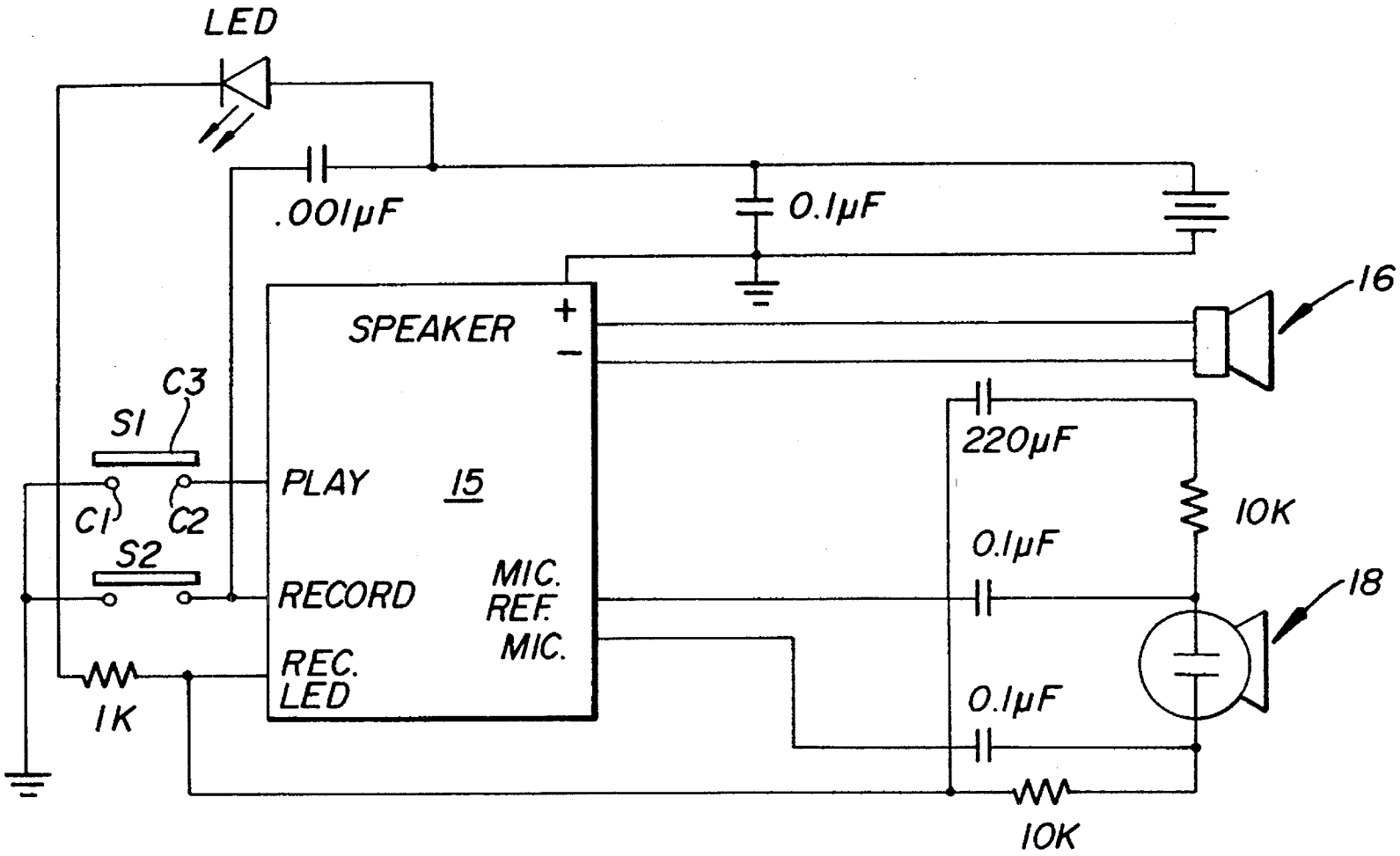
FIG. 8 is an electrical schematic of an electronic audio system useful in the talking picture frame of the invention.

Referring now to the drawings, FIGS. 1–6 illustrate a talking picture frame 10 embodying the present invention. Frame 10 is preferably rectangular in shape and comprises picture-mounting means (not shown) for retaining a photograph or picture 12 at a central location within the frame boundaries. An audio module 14 is incorporated into a widened portion 10A of the frame to provide, on command, audio information (e.g., a voice message or music) associated with the displayed picture. The audio module is preferably of the solid state variety and includes a microcontroller 15 of the type comprising an integral audio integrated circuit (IC) memory chip. A preferred controller is one of the family of "Single-Chip Voice Record/Playback Devices", such as the Series 1100, made and sold by Information Storage Devices, San Jose, Calif. Audio module 14 further comprises a small audio loudspeaker 16 for broadcasting a prerecorded message stored in the microcontroller's memory chip, and a tiny microphone 18 for inputting such message into the memory chip. The audio module also includes a PLAYBACK switch S1 (discussed in more detail below) for providing a control signal to initiate a PLAYBACK mode in which a pre-recorded message in the controller is broadcast, and a RECORD switch S2 mounted on the rear side of the frame structure (as shown in FIG. 2) for selectively operating the microcontroller in the RECORD mode in which the microphone is used to input desired audio information to the memory chip. The manner in which these components are connected is illustrated in FIG. 8. Electrical power to the audio module is provided by a 6 volt battery.

Figure 1:
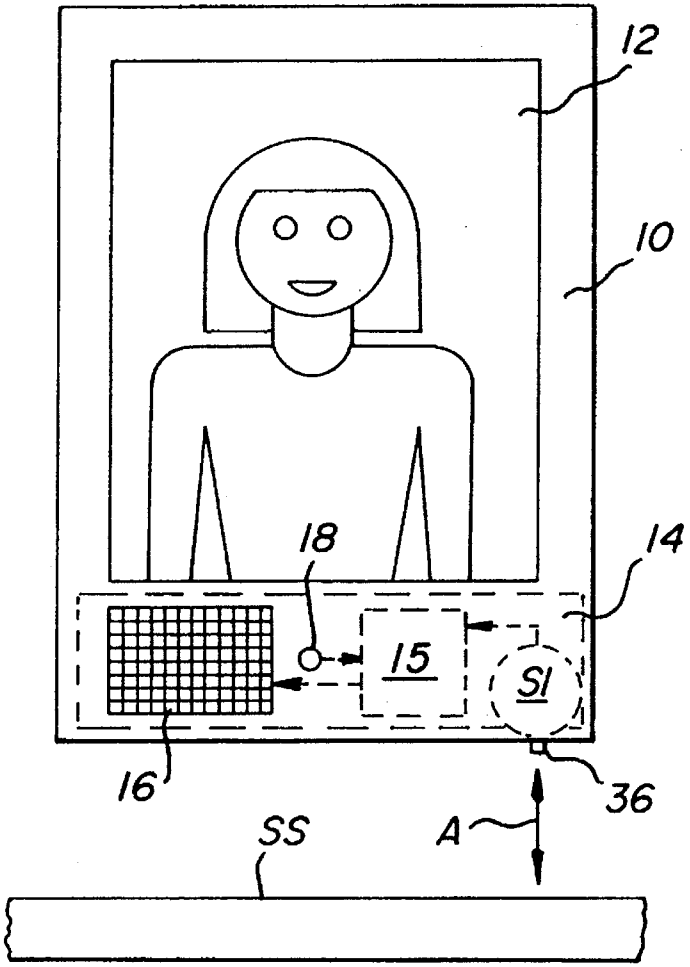
FIG. 1 is a front plan illustration of a talking picture frame embodying the present invention.
Figure 4:
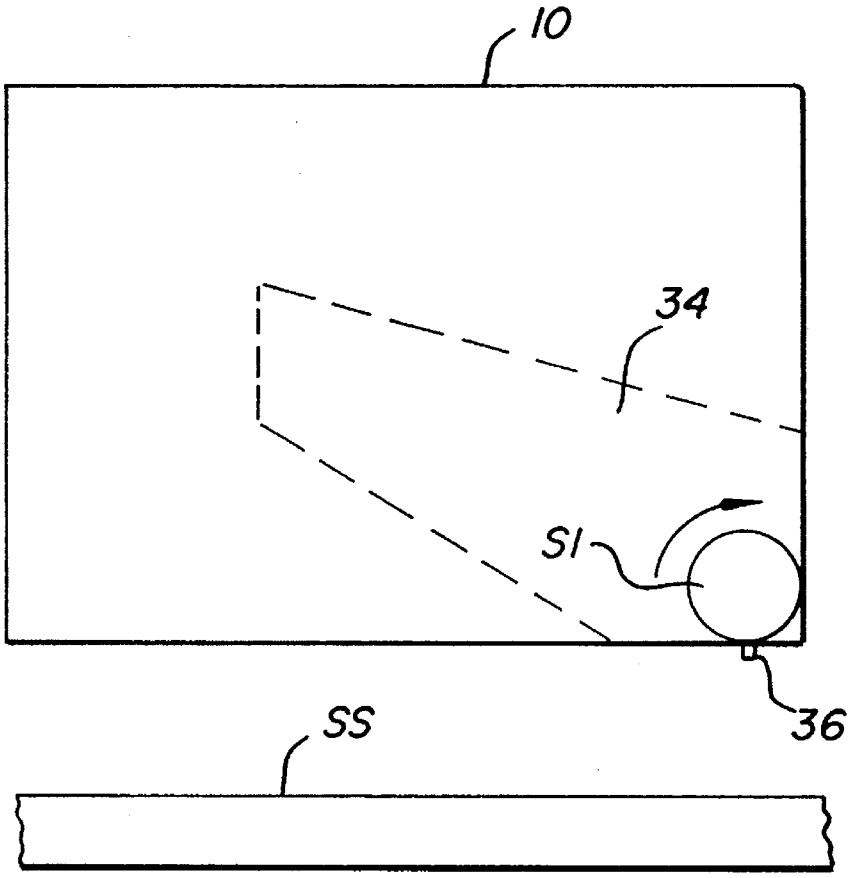
FIGS. 3 and 4 are front and rear plan views, respectively, of the FIG. 1 frame upon being rotated by 90 degrees.
Figure 3:
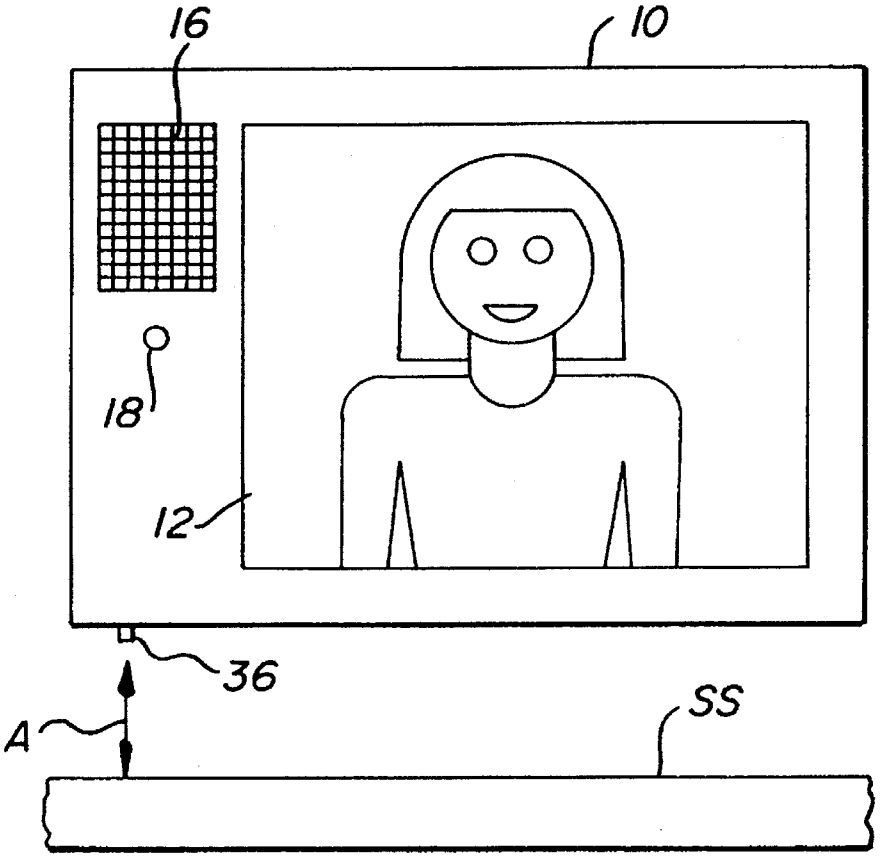
Figure 5:
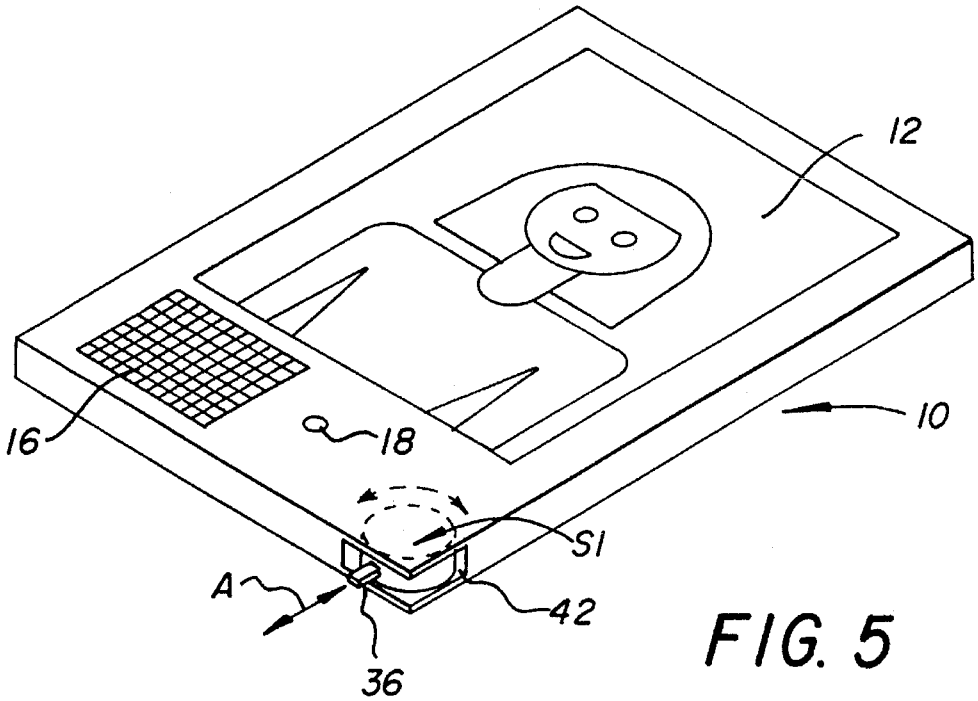
FIG. 5 is a perspective view of the FIG. 1 frame.
Figure 6:
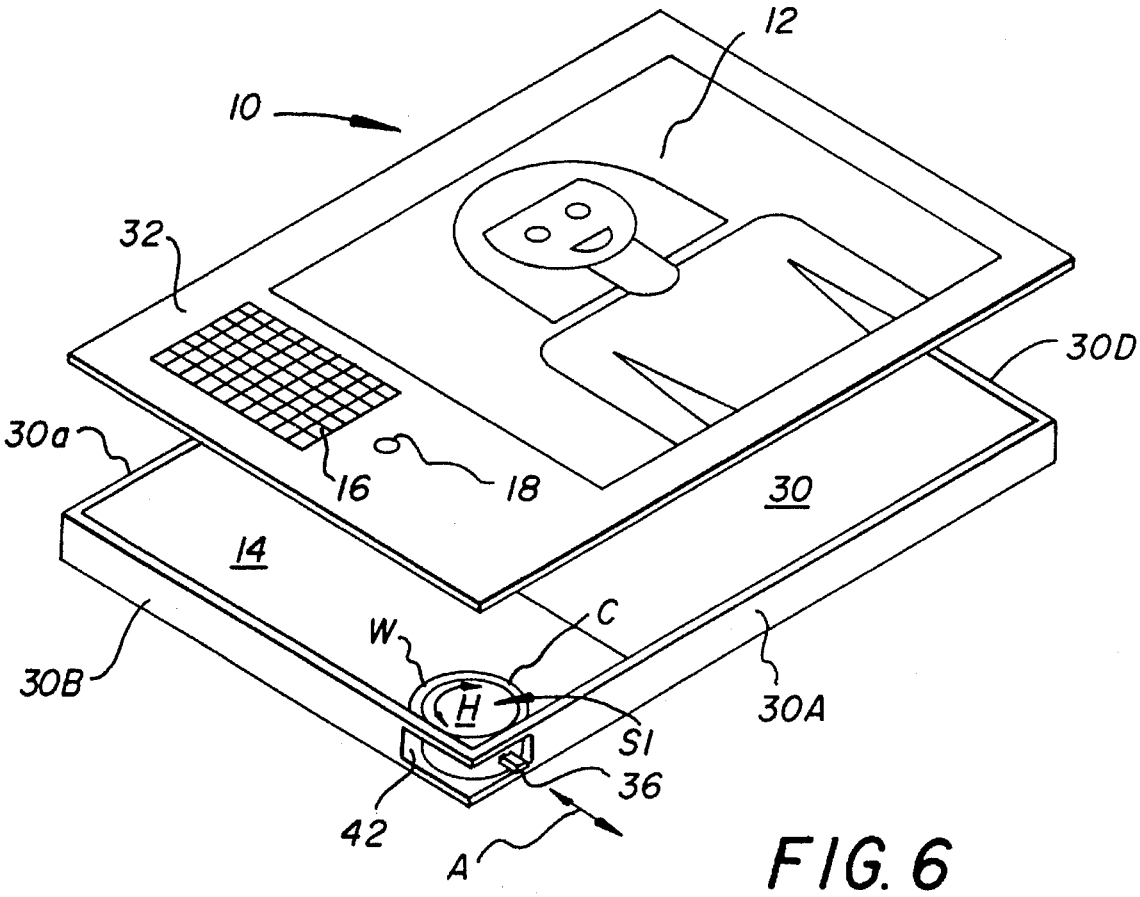
FIG. 6 is an exploded perspective illustration of the FIG. 3 frame.
Figure 7A:
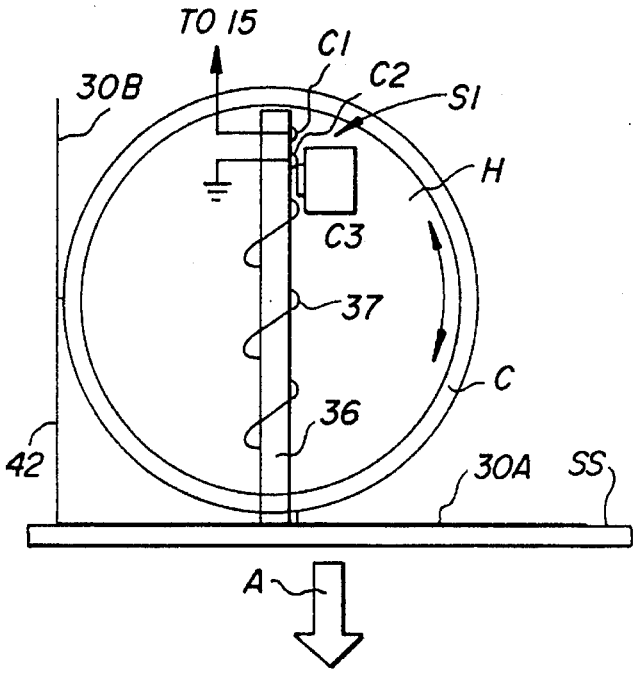
FIGS. 7A–7C are schematic illustrations of a rotatably mounted switch showing the switch actuator in three different positions.
Figure 7B:
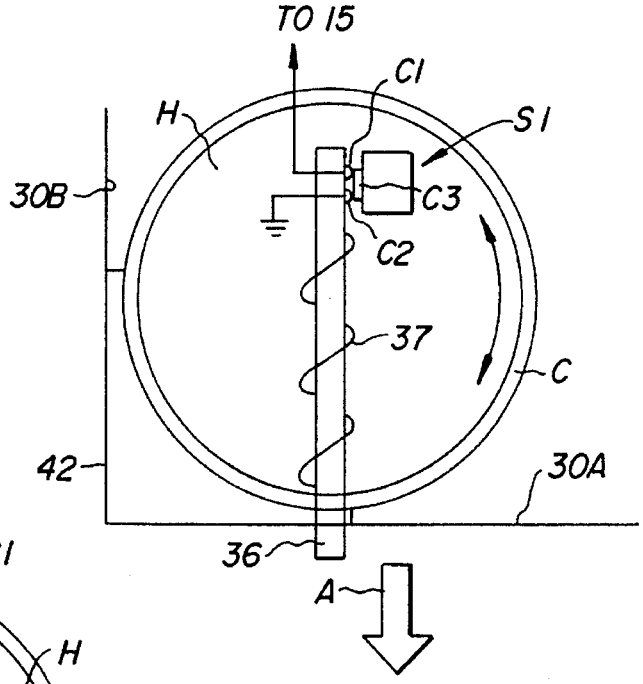
Figure 7C:
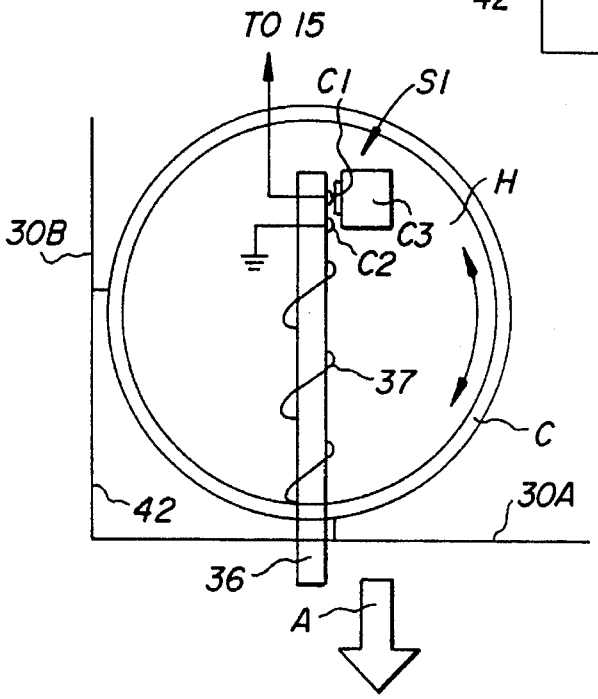

As best shown in FIGS. 5 and 6, picture frame 10 comprises a box-like structure defined by a rectangular base 30 having upwardly extending walls 30A–30D, and a cover plate 32 which is adapted to support the picture 12 at a central location. The cover plate may be attached to the top of the base walls by an adhesive, screws, or other fasteners. As shown in FIGS. 2 and 4, a fold-out stand 34 is attached to the rear surface of base 30 and functions in cooperation with a frame-supporting surface SS, to support the frame in an upright position in either a "portrait" orientation, as shown in FIG. 1, or in a "landscape" orientation, as shown in FIG. 3. An arcuate wall W attached to the interior of base 30 defines, at a corner location within the audio module region, a cylindrically-shaped cavity C which is adapted to receive a correspondingly shaped switch housing H containing the PLAYBACK switch S1. As best shown in FIGS. 7A–7C, switch S1 includes a plunger-type actuator 36 which is slidably mounted within the switch housing so as to move, in the direction of the arrow A, from an extended position, as shown in FIG. 7C, to a retracted position, as shown in FIG. 7A. Actuator 36 supports a pair of spaced electrical contacts C1,C2, one of which is electrically grounded, and the other is electrically connected to the microcontroller 15. A third contact C3, mounted at a fixed location in the switch housing H, bridges the contacts C1 and C2 during sliding movement of the switch actuator between its extended and retracted positions. When an electrical connection is made between contacts C1 and C2, a control signal is provided to the controller to cause playback of the recorded audio message. Actuator 36 is biased by a coil spring 37 towards its extended position in which the actuator extends outwardly, or downwardly, as viewed in FIGS. 1 and 3, from the edge of the frame. Thus, whenever the frame is resting on the support surface SS, actuator A is urged by the weight of the frame towards its retracted position shown in FIG. 7A. In this position, the electrical contact C1 has moved beyond the bridging contact C3 and no control signal is produced. When, however, the frame is lifted from the supporting surface SS, the coil spring moves the actuator towards its extended position and, during such movement, contacts C1 and C2 are momentarily bridged by fixed contact C3, as shown in FIG. 7B, and a control signal will be produced which causes the prerecorded audio message to play back. As the switch actuator continues moving under the spring force to its fully extended position, shown in FIG. 7C, electrical contact between contacts C1 and C2 is broken. Obviously, when the frame is returned to its position atop the supporting surface, the actuator will be moved towards its retracted position, and the audio message will again play back as a momentary connection is made between contacts C1 and C2.

A particularly advantageous feature of the invention is that the cylindrically-shaped housing H of switch S1 is rotatably mounted within the cavity C located in a corner of the frame. By simply manually rotating the switch housing by 90 degrees, the PLAYBACK switch actuator 36 can be positioned to extend downwardly from the frame housing from either of two adjacent edges of the frame. Thus, actuator 36 can be engaged and moved by the frame-supporting surface to its retracted position shown in FIG. 7A, whether the frame is in its "portrait" or "landscape" orientation. As shown in FIGS. 5 and 6, a portion of each of the adjacent side walls 30A and 30B located at a corner of the frame base 30 are removed to define an opening 42 which allows the extended switch actuator to move from its position shown in FIGS. 1 and 2, to its position shown in FIGS. 3 and 4. This feature enables the frame to be used and operated in either portrait or landscape orientation by using a single lift-actuated switch to control playback. Thus, only one style of frame need be manufactured and stocked. Also, by positioning the PLAYBACK switch as shown, playback of the recorded message can be effected by either lifting the frame from its supporting surface or, in the case where the frame is hung on a wall, by manually depressing and releasing the switch actuator. Since the switch actuator is edge-mounted on the frame, it does not interfere with the style or appearance of the frame or photograph. Also, because the position of the switch actuator is movable, the switch position can be optimized for hand-held or wall-mounted applications.

In FIG. 9, an electrical schematic of the audio module is provided. As illustrated, the heart of the module is a ISD 1100 Single Chip Voice Record/Playback Device made by Information Storage Devices. To record a voice message, RECORD switch S2 is pressed and held. The RECORD light-emitting diode (LED) is illuminated to indicate that recording is in progress. If the chip's memory capacity is exceeded, the LED goes out and the device automatically powers down. To playback a recorded message, the RECORD switch S1 is either released or pressed, thereby making momentary connection between the contacts. The message stored in the device will playback until it reaches a set bit, whereupon the playback will cease and the device will power down.

While the invention has been described with reference to a preferred embodiment, it will be appreciated that various modifications can be made without departing from the spirit of the invention. Such modifications are intended to fall within the scope of the appended claims.

List of Reference Characters

10 frame
12 picture
14 audio module
15 microcontroller
16 loud speaker
18 microphone
30 frame base
30A–30D frame base walls
32 cover plate
34 frame stand
36 switch actuator
36A actuator contact
37 spring
42 opening in frame
S1 PLAYBACK switch
S2 RECORD switch
H switch housing
C cavity
A arrow
C1,C2,C3 switch contacts

What is claimed is:

1. Apparatus for displaying pictorial in formation while selectively providing audio information adapted, to enhance the content of the pictorial information, said apparatus comprising:

(a) a frame for accommodating a picture provided by a user, said frame having a first side adapted to rest upon a frame-supporting surface to support the frame in a first orientation, and a second side adapted to rest upon such frame-supporting surface to support the frame in a second orientation different from said first orientation;

(b) an audio system operatively coupled to said frame for selectively playing prerecorded audio information in response to receiving an electric control signal; and (c) an electric switch for selectively producing said electric control signal, said switch comprising (i) a switch actuator slidably mounted for movement between extended and retracted positions, said switch actuator being adapted to produce said control signal during movement between said extended and retracted positions; (ii) biasing means for normally biasing said switch actuator towards its extended position; and (iii) mounting means for movably mounting said switch actuator on said frame for movement between a first position in which said switch actuator, when located in its extended position, extends outwardly from said first side of the frame, and a second position in which said switch actuator, when located in its extended position, extends outwardly from said second side of the frame.

2. The apparatus as defined by claim 1 wherein said switch actuator is positioned on the frame to be contacted by a frame-supporting surface when said switch is located in one of said first and second positions and when one of said first and second sides of the frame, respectively, is resting upon such frame-supporting surface, said switch actuator being adapted to be moved from its extended position to its retracted position by a force exerted by the weight of the frame interacting with the frame-supporting surface.

3. The apparatus as defined by claim 1 wherein said first and second frame sides are perpendicular to each other.

4. The apparatus as defined by claim 3 wherein said switch actuator is rotatably mounted on said frame for movement of at least 90 degrees.

5. Picture framing apparatus for displaying a picture while selectively providing audio information associated with the picture displayed, said apparatus comprising:

(a) a frame for accommodating a picture provided by a user, said frame defining a rectangular enclosure having a first side adapted to rest upon a frame-supporting surface to support the frame in a first orientation, and a second side perpendicular to said first side, adapted to rest upon such frame-supporting surface to support the frame in a second orientation perpendicular to said first orientation;

(b) an electronic audio system disposed within said enclosure for selectively playing prerecorded audio information upon being electrically energized; and (c) an electric switch for selectively energizing said electronic audio system, said switch comprising (i) a switch actuator slidably mounted for movement between extended and retracted positions, said switch actuator being adapted to energize said electronic audio system during movement between said extended and retracted positions; (ii) biasing means for normally biasing said switch actuator towards its extended position; and (iii) mounting means located adjacent a vertex of said rectangular enclosure for movably mounting said switch actuator on said frame for movement between a first position in which said switch actuator, when located in its extended position, extends outwardly from said first side of the frame, and a second position in which said switch actuator, when located in its extended position, extends outwardly from said second side of the frame.

6. The apparatus as defined by claim 5 wherein said switch actuator is positioned on the frame to be contacted by a frame-supporting surface when said switch is located in one of said first and second positions and when one of said first and second sides of the frame, respectively, is resting upon such frame-supporting surface, said switch actuator being adapted to be moved from its extended position to its retracted position by a force exerted by the weight of the frame interacting with the frame-supporting surface.

7. The apparatus as defined by claim 5 wherein said switch actuator is rotatably mounted on said frame for arcuate movement of at least 90 degrees.

8. The apparatus as defined by claim 7 wherein a portion of each of said first and second sides of said frame are removed to enable uninhibited arcuate movement of said switch actuator between its first and second positions.

* * * * *